US005522136A

United States Patent [19]

Larisey

[11] Patent Number: 5,522,136

[45] Date of Patent: Jun. 4, 1996

[54] NAIL CLIPPER

[76] Inventor: William Larisey, 2007 Cordova Dr., Sanford, Fla. 32771

[21] Appl. No.: 317,018

[22] Filed: Oct. 3, 1994

[51] Int. Cl.[6] ..... A45D 29/02

[52] U.S. Cl. ..... 30/28; 30/124; 132/75.5

[58] Field of Search ..... 30/26, 27, 28, 30/29, 134, 124; 132/73, 73.5, 75.3, 75.4, 75.5; D28/56, 60

[56] References Cited

U.S. PATENT DOCUMENTS

| | | | |
|---|---|---|---|
| 2,515,852 | 7/1950 | Bilsky | 30/28 |
| 3,154,850 | 11/1964 | Okuno | 30/28 |
| 3,188,737 | 6/1965 | Chase | 30/28 |
| 4,117,591 | 10/1978 | Terry | 30/124 |
| 4,776,090 | 10/1988 | Grassi | 30/28 |
| 4,982,747 | 1/1991 | Shah | 132/75.5 |

FOREIGN PATENT DOCUMENTS

| | | | |
|---|---|---|---|
| 2042712 | 11/1992 | Canada | 30/28 |

*Primary Examiner*—Hwei-Siu Payer
*Attorney, Agent, or Firm*—B. Craig Killough

[57] ABSTRACT

A nail clipper having a first jaw and a second jaw in a spring biased relationship, wherein said jaws are displaced toward each other to cut a nail which is placed between a cutting blade of the jaws. An arcuate leaf member is present between the jaws and is displaced by one of the jaws toward the remaining jaw, wherein said leaf contacts the nail before the nail is cut so that the leaf directs the nail, such as directing the nail into a receptacle.

12 Claims, 3 Drawing Sheets

NAIL CLIPPER

FIELD OF THE INVENTION

This invention relates to nail clippers generally, and is particularly directed to a nail clipper having a leaf which directs a nail which is cut by the nail clipper's blades into a receptacle for subsequent disposal of the severed nail.

BACKGROUND OF THE INVENTION

Human fingernails and toenails require occasional cutting or trimming. Nails are cut or trimmed for functional as well as aesthetic purposes.

Nail trimmers as known or used comprise various configurations. A common configuration comprises scissors which are particularly shaped or formed to leave a desired shape of the nail. Another common configuration uses opposing jaws which are sharpened to blades on one end. The jaws are displaced towards each other to contact and sever the nail as the blades come to rest against each other.

A shortcoming of nailclippers known in the prior art is that the nail which is severed by the nail clipper falls away from the nail clipper in an uncontrolled fashion and is not collected for proper disposal. After trimming the nails of all ten digits, a considerable amount of debris in the form of severed fingernails remains. Accordingly, the act of trimming nails must either take place over a receptacle, or substantial care must be taken to accumulate the severed nails for subsequent disposal.

SUMMARY OF THE PRESENT INVENTION

The present invention employs opposing jaws which are sharpened, or otherwise provided with a blade on one end thereof. A leaf is placed between the jaws, and in contact with one of the jaws. The leaf has a free end which extends from a point of contact with an inner surface of one of the jaws toward the blade of the jaw.

The free end of the leaf has an arcuate shape which curves away from the jaw with which the leaf is contact. The opposing jaws are displaced toward each other. The nail is placed between the blades of the opposing jaws, and as the jaws move toward each other, the blades contact and sever the nail, as the blades come in contact with each other. The arcuate shape of the free end of the leaf causes the leaf to travel toward the nail and contact the end of the nail prior to the jaws contacting and severing the nail, so that the leaf directs the severed nail into a receptacle. Severed nails may be accumulated in the receptacle for subsequent disposal.

DESCRIPTION OF THE PREFERRED EMBODIMENT

Figure 1:
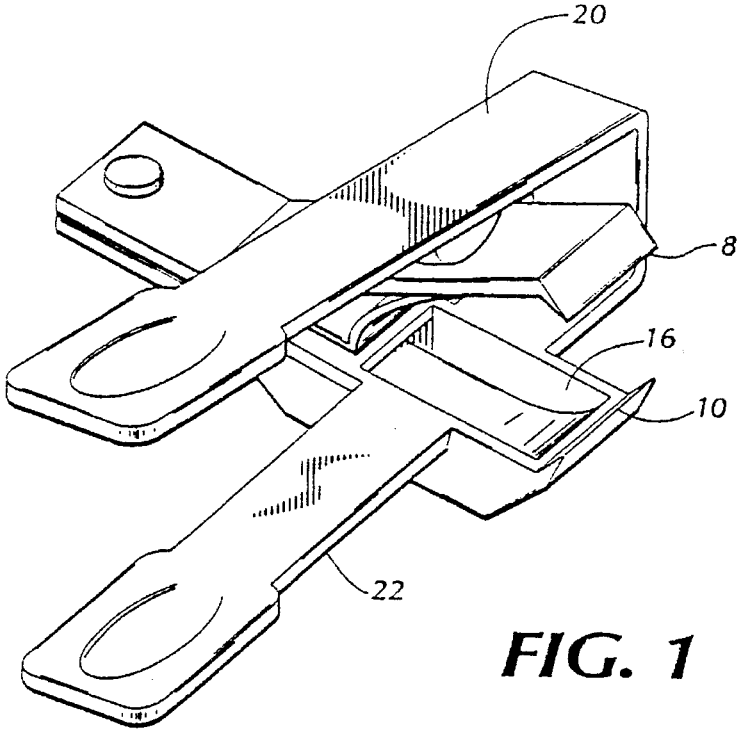
FIG. 1 is a perspective view of the nail clipper.

Referring now to the drawing figures, a first jaw 2 and a second jaw 4 are shown. The jaws 2,4 are in a spring biased relationship. The spring biased relationship may be accomplished by fastening the jaws together in a fixed relationship near one end of each of the jaws. A fastener 6 may be used to fasten the jaws together. The fastener may be a rivet, or brad, or other known fastener. The jaws could be welded or otherwise connected by known means.

The opposite end of the first jaw and the opposite end of the second jaw are free, or open. Each jaw has a blade 8,10 or cutting edge formed or fixed to the open end of the jaw. The blade may be a sharp point which is formed by casting, grinding, molding, sharpening or otherwise forming a point or cutting edge on the blade end of the jaw.

Figure 2:
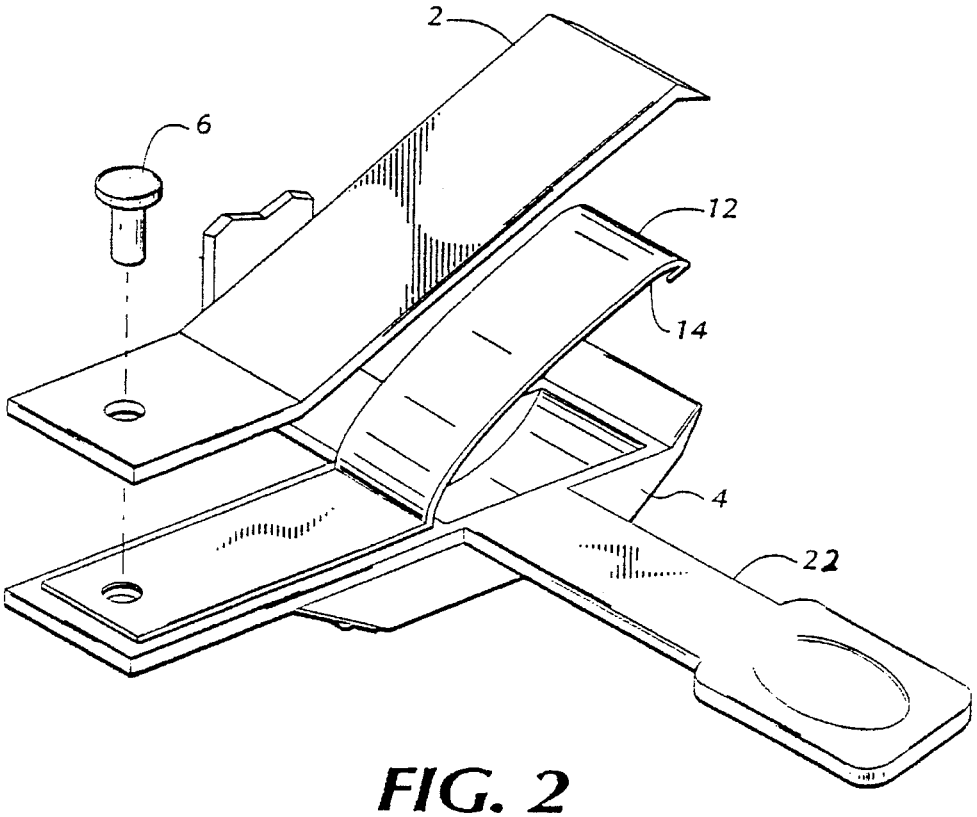
FIG. 2 is an exploded view of the nail clipper.
Figure 3:
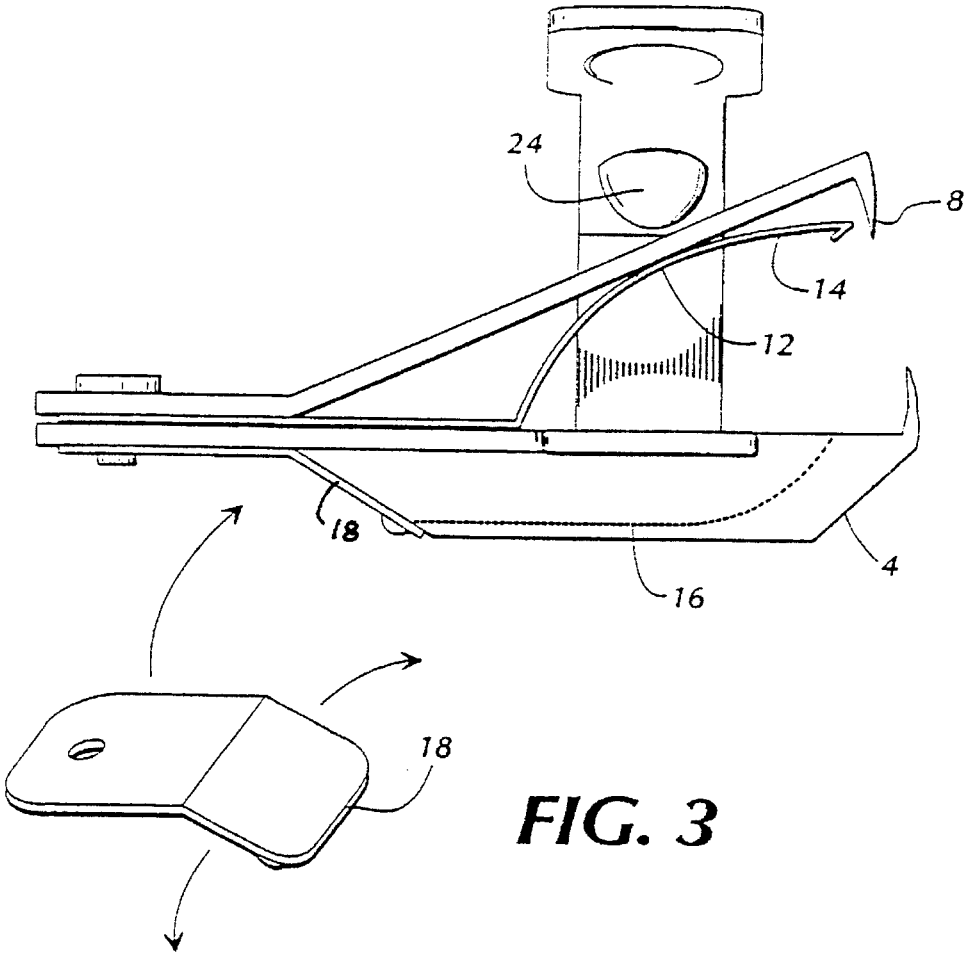
FIG. 3 is a side elevation of the nail clipper, which is partially sectioned to show the nail receptacle.
Figure 4:
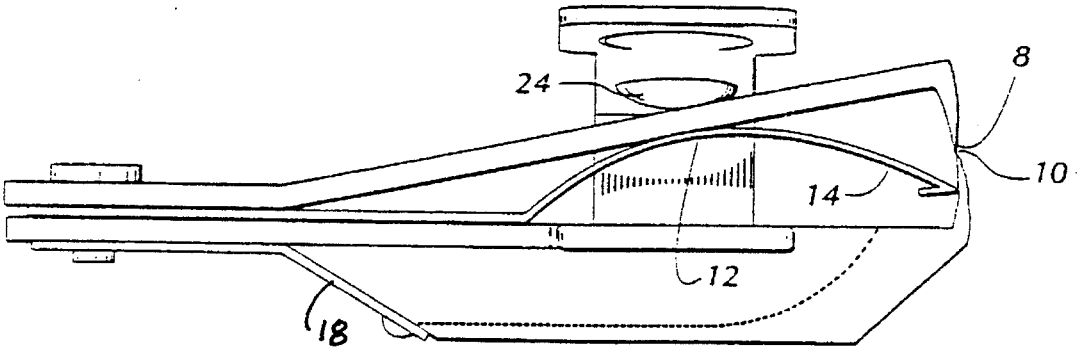
FIG. 4 is a side elevation of the nail clipper.
Figure 5:
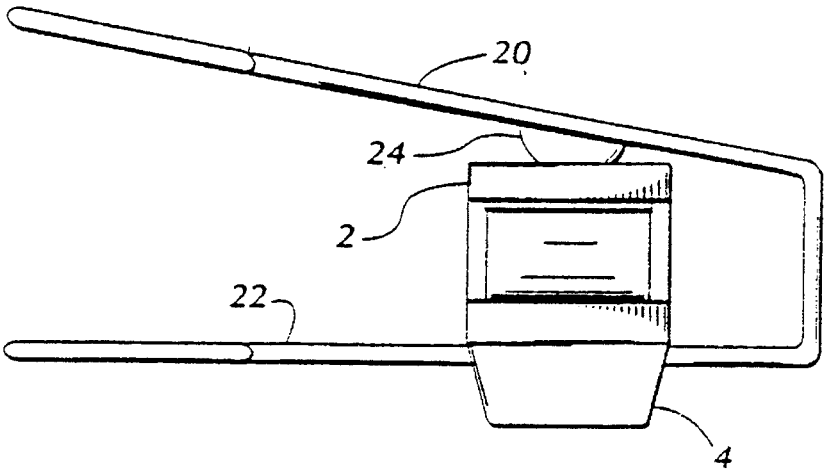
FIG. 5 is a front elevation of the nail clipper.
Figure 6:
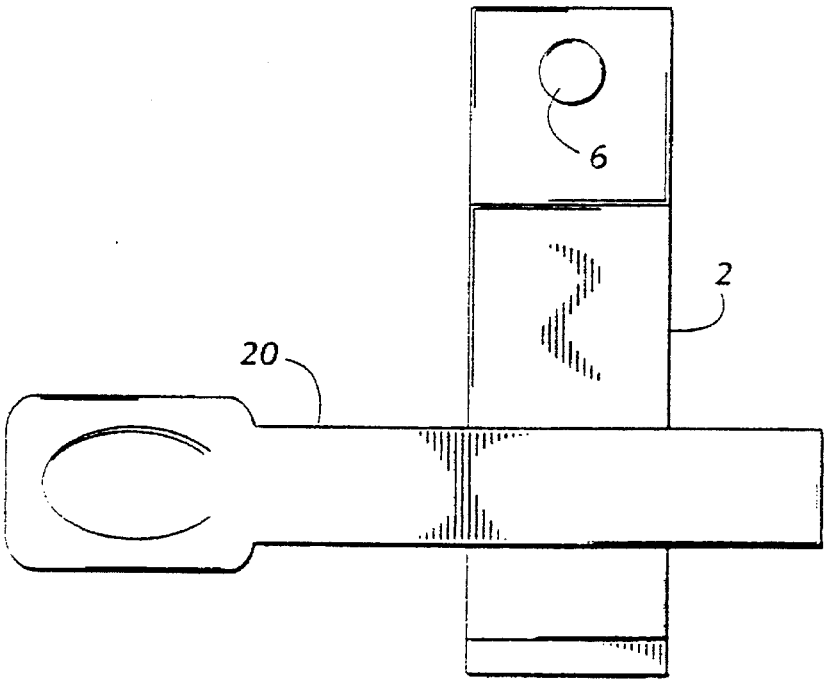
FIG. 6 is a top, plan view of the nail clipper.

A leaf 12 is present between the first jaw and the second jaw. The leaf is in a spring biased relationship with the jaws. The leaf may be fixed between the first jaw and the second jaw by the fastener. FIG. 2. The leaf has a free end 14 which begins at a point of contact between the first jaw and the leaf, and extends toward the blade or cutting edge of the first jaw. FIG. 3.

A receptacle 16 is provided to collect nail clippings. The receptacle is an open container which is positioned on the interior of the nail clipper, opposite the leaf. The receptacle may be formed within the second jaw as shown, or it could be connected to the device so as to collect and contain nail clippings.

A opening or door may be provided on an exterior surface of the receptacle to aid in removing clippings from the receptacle the opening or door may be positioned on the underside of the receptacle, at one end of the receptacle, with a door cover 18 positioned over the opening or door. (FIG. 3). The door cover 18 may be placed in a pivotal relationship with the receptacle, such as by means of fastener 6. An opening or void which provides access to the receptacle is present on one end of the container as shown in the drawings. Door cover 18 may be pivoted away to expose the opening so that the nail clippings or other debris may be eliminated from the device.

A lever 20 may be provided to facilitate displacement of the jaws towards each other. The lever may be positioned over the first jaw. When the lever is displaced, the first jaw is in turn displaced toward the second jaw to actuate the device. A handle 22 may also be provided to hold the device while displacing the lever. A side extension of the handle and the lever from the jaws is deemed to be superior in aiding the user in aligning the device on the nails, however, other positions of the lever and/or handle could be used.

A cam 24 may be provided which contacts an outer surface of the upper jaw as the lever is compressed. The cam should have a curved surface to allow it to move along the surface of the first jaw as the first jaw is compressed. The lever is in a spring biased relationship with the device by means of the lever being connected at one end to the device, while having an opposite end which is free.

In use, a fingernail or toenail is placed between the open ends of the first jaw and the second jaw. The open end of the first jaw is displaced toward the open end of the second jaw, until the blades of the jaws strike and sever the nail. The blade of the first jaw stops upon striking the blade of the second jaw, with the blades acting to sever the nail.

As the first jaw is displaced toward the second jaw, the open end of the leaf is forced downwardly toward the nail. The curved, or arcuate, shape of the open end of the leaf from the point of contact of the leaf with the first jaw as it extends towards the blade causes the front edge of the leaf to strike the nail before the blade of the first jaw strikes the nail. The leaf pushes the portion of the nail to be severed downward, and as the nail is severed, the leaf directs the nail into the receptacle. Through the use of the leaf, the nail is directed into the receptacle, and does not fall in an uncontrolled manner from the nail clipper. Because of the curved, or arcuate, shape of the leaf, the front edge of the leaf travels downwardly so as to reach the nail before the blade of the first jaw, with that the leaf controlling the nail as it is severed.

The jaws are displaced by manual pressure applied to the jaws. Manual pressure may be applied by the lever provided. When pressure is released from the jaws, the spring biasing of the jaws causes the jaws to separate, to allow a nail to be inserted between the jaws.

What is claimed:

1. A nail clipper, comprising:

a. a first jaw having a cutting blade;

b. a second jaw which is in a hinged relationship with said first jaw and is normally spaced apart from first jaw on at least one end thereof, and wherein said first jaw is capable of displacement toward said second jaw, and contacts a cutting blade of said second jaw as said first jaw and said second jaw are displaced toward each other; and c. a leaf spring which is positioned between said first jaw and said second jaw, said leaf spring having a free end which extends from a point of contact of said leaf spring with said first jaw toward said cutting blade of said first jaw, wherein said leaf spring has an arcuate shape from said point of contact of said leaf spring with said first jaw to said free end, and wherein said leaf spring is displaced toward said second jaw as said first jaw is displaced toward said second jaw, and said free end moves to a position which is lower than an upper surface of said cutting blade of said second jaw when said second jaw contacts said cutting blade of said first jaw, and said free end contacts a nail placed between said first jaw and said second jaw prior to said first jaw contacting said nail.

2. A nail clipper as described in claim 1, further comprising a receptacle which is opposite said leaf spring.

3. A nail clipper as described in claim 17, further comprising a first lever which is positioned over said first jaw and which extends from one side of said second jaw at generally a right angle, and a second lever which extends from said second jaw generally parallel to said first lever, and wherein displacement of said first lever and said second lever toward each other causes displacement of said first jaw toward said second jaw.

4. A nail clipper as described in claim 1, further comprising a receptacle which is opposite said leaf spring, wherein said receptacle has an opening therein, and wherein said opening has a cover which selectively covers and uncovers said opening.

5. A nail clipper as described in claim 18, further comprising a first lever which is positioned over said first jaw and which extends from one side of said second jaw at generally a right angle, and a second lever which extends from said second jaw generally parallel to said first lever, and wherein displacement of said first lever and said second lever toward each other causes displacement of said first jaw toward said second jaw.

6. A nail clipper as described in claim 1, further comprising a first lever which is positioned over said first jaw and which extends from one side of said second jaw at generally a right angle, and a second lever which extends from said second jaw generally parallel to said first lever, and wherein displacement of said first lever and said second lever toward each other causes displacement of said first jaw toward said second jaw.

7. A nail clipper, comprising:

a. a first jaw having a cutting blade;

b. a second jaw which is in a hinged relationship with said first jaw and is normally spaced apart from first jaw on at least one end thereof, and wherein said first jaw is capable of displacement toward said second jaw, and contacts a cutting blade of said second jaw as said first jaw and said second jaw are displaced toward each other; and c. a leaf spring which is positioned between said first jaw and said second jaw, said leaf spring having a free end which extends from a point of contact of said leaf spring with said first jaw toward said cutting blade of said first jaw, and wherein said leaf spring is displaced toward said second jaw as said first jaw is displaced toward said second jaw, and said free end moves to a position which is lower than an upper surface of said cutting blade of said second jaw when said second jaw contacts said cutting blade of said first jaw, and said free end contacts a nail placed between said first jaw and said second jaw prior to said first jaw contacting said nail.

8. A nail clipper as described in claim 7, further comprising a receptacle which is opposite said leaf spring.

9. A nail clipper as described in claim 8, further comprising a first lever which is positioned over said first jaw and which extends from one side of said second jaw at generally a right angle, and a second lever which extends from said second jaw generally parallel to said first lever, and wherein displacement of said first lever and said second lever toward each other causes displacement of said first jaw toward said second jaw.

10. A nail clipper as described in claim 7, further comprising a receptacle which is opposite said leaf spring, wherein said receptacle has an opening therein, and wherein said opening has a cover which selectively covers and uncovers said opening.

11. A nail clipper as described in claim 10, further comprising a first lever which is positioned over said first jaw and which extends from one side of said second jaw at generally a right angle, and a second lever which extends from said second jaw generally parallel to said first lever, and wherein displacement of said first lever and said second lever toward each other causes displacement of said first jaw toward said second jaw.

12. A nail clipper as described in claim 7, further comprising a first lever which is positioned over said first jaw and which extends from one side of said second jaw at generally a right angle, and a second lever which extends from said second jaw generally parallel to said first lever, and wherein displacement of said first lever and said second lever toward each other causes displacement of said first jaw toward said second jaw.

* * * * *